US008674625B2

(12) United States Patent
So

(10) Patent No.: US 8,674,625 B2
(45) Date of Patent: Mar. 18, 2014

(54) SYNCHRONOUS LIGHT ADJUSTMENT METHOD AND THE DEVICE FOR PERFORMING THE SAME

(76) Inventor: Yu-Sheng So, New Taipei Hsien (TW)

( * ) Notice: Subject to any disclaimer, the term of this patent is extended or adjusted under 35 U.S.C. 154(b) by 68 days.

(21) Appl. No.: 13/466,114

(22) Filed: May 7, 2012

(65) Prior Publication Data

US 2013/0069539 A1 Mar. 21, 2013

Related U.S. Application Data

(63) Continuation-in-part of application No. 13/237,959, filed on Sep. 21, 2011.

(51) Int. Cl.
*H05B 37/02* (2006.01)

(52) U.S. Cl.
USPC ..... 315/307; 315/152; 315/312; 315/360

(58) Field of Classification Search
USPC ..... 315/149–159, 210, 250, 291, 294, 307, 315/312, 360, 362
See application file for complete search history.

(56) References Cited

U.S. PATENT DOCUMENTS

| | | | | |
|---|---|---|---|---|
| 5,455,487 | A * | 10/1995 | Mix et al. | 315/150 |
| 6,445,139 | B1 * | 9/2002 | Marshall et al. | 315/291 |
| 2010/0060195 | A1 * | 3/2010 | Tsuboi et al. | 315/294 |
| 2010/0277076 | A1 * | 11/2010 | Tracy et al. | 315/149 |
| 2011/0193491 | A1 * | 8/2011 | Choutov et al. | 315/291 |

* cited by examiner

*Primary Examiner* — Tung X Le
(74) *Attorney, Agent, or Firm* — Kolisch Hartwell, P.C.

(57) ABSTRACT

A synchronous light adjustment method and the device for performing the same are proposed. Each of plurality of lamps is installed with a light sensor and a control unit. By actuating a single power switch, the control unit will control the illumination of a respective one of the LED lamps independently and automatically based on the environmental illumination detected by a light sensor. Further, by switching the power switch manually to match predetermined operations, the control units will adjust the illuminations and color temperatures of the LED lamps synchronously and gradually. The device is convenient in installation and usage.

17 Claims, 10 Drawing Sheets

SYNCHRONOUS LIGHT ADJUSTMENT METHOD AND THE DEVICE FOR PERFORMING THE SAME

The application is a continuation in part (CIP) of U.S. patent application Ser. No. 13/237,959 filed Sep. 21, 2011 which is assigned to the inventor of the present invention, and thus the contents of the application is incorporated into the present invention as a part of the present invention.

FIELD OF THE INVENTION

The present invention relates to a synchronous light adjustment method and the device for performing the same, in particular to a method and a device, in that when a plurality of LED lamps are actuated, their illuminations will be adjusted automatically; while the illuminations and color temperatures thereof can be adjusted manually.

BACKGROUND OF INVENTION

Most of current LED lamps have forms of tubes, bulbs, or plates, and are widely used indoor. Besides, many light adjusting methods and related devices are developed, such as silicon-controlled, wired controlled, and wireless remote controlled light adjustments for providing functions of non-full illumination to have the effect of power saving.

However above mentioned method needs extra controllers, or transceiver devices, and connecting wires to achieve the object of light synchronous adjustment. The work is complicated and cost is high. As a result, it cannot be accepted by most peoples and thus is not widely used.

SUMMARY OF THE INVENTION

The object of the present invention is to provide an intellectual auto-and-manual light control method for both illumination and color temperature adjustments. The manual operation is performed continuously and gradually. Furthermore, a device for realizing above method is provided, in that the device can be assembled easily so as to overcome the problems in the prior art. Thus light adjustment are widely accepted and objects of power saving and environment protection are achieved. Besides, the method of the present invention adapts original wires used in lamps. No extra control wire is needed so that assembly work is easy and the use is convenient.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
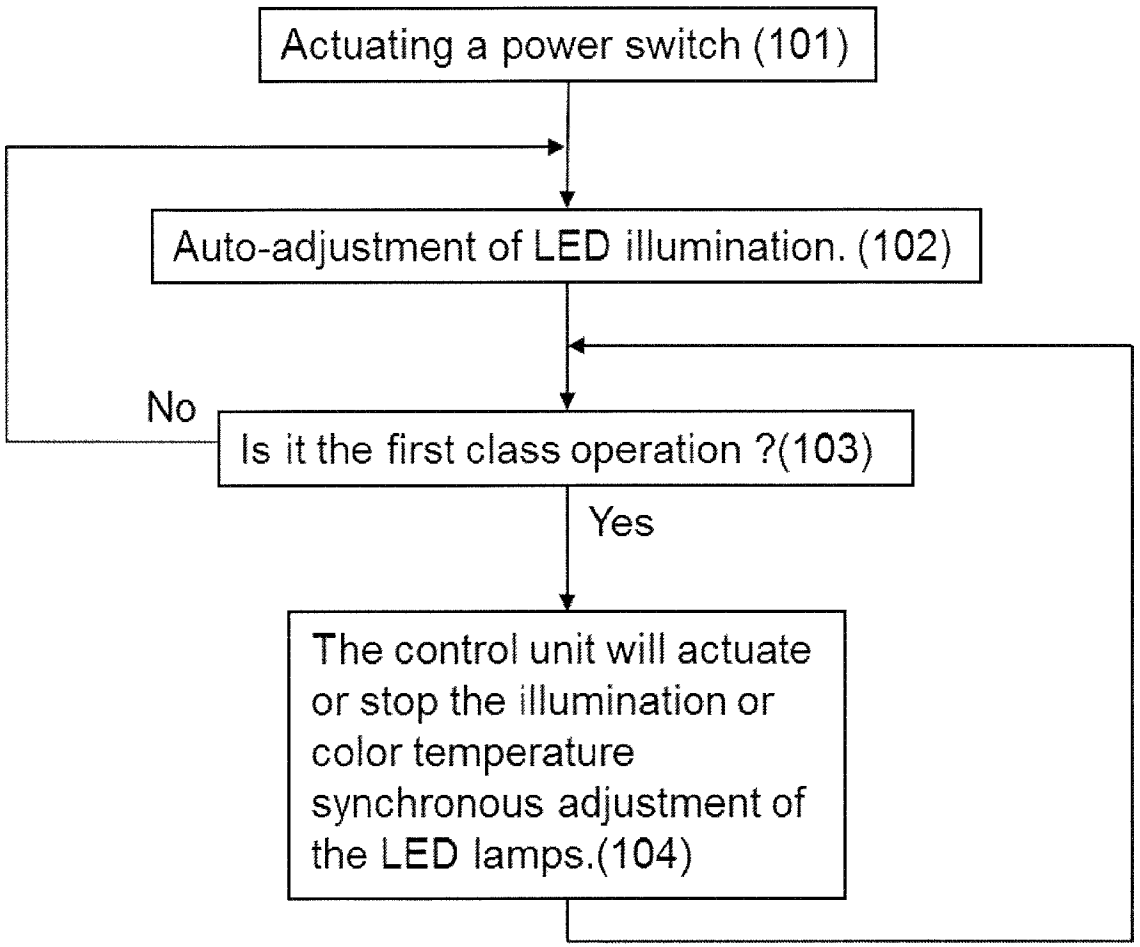
FIG. 1 is a block diagram showing the process in a first embodiment of the present invention.
Figure 2:
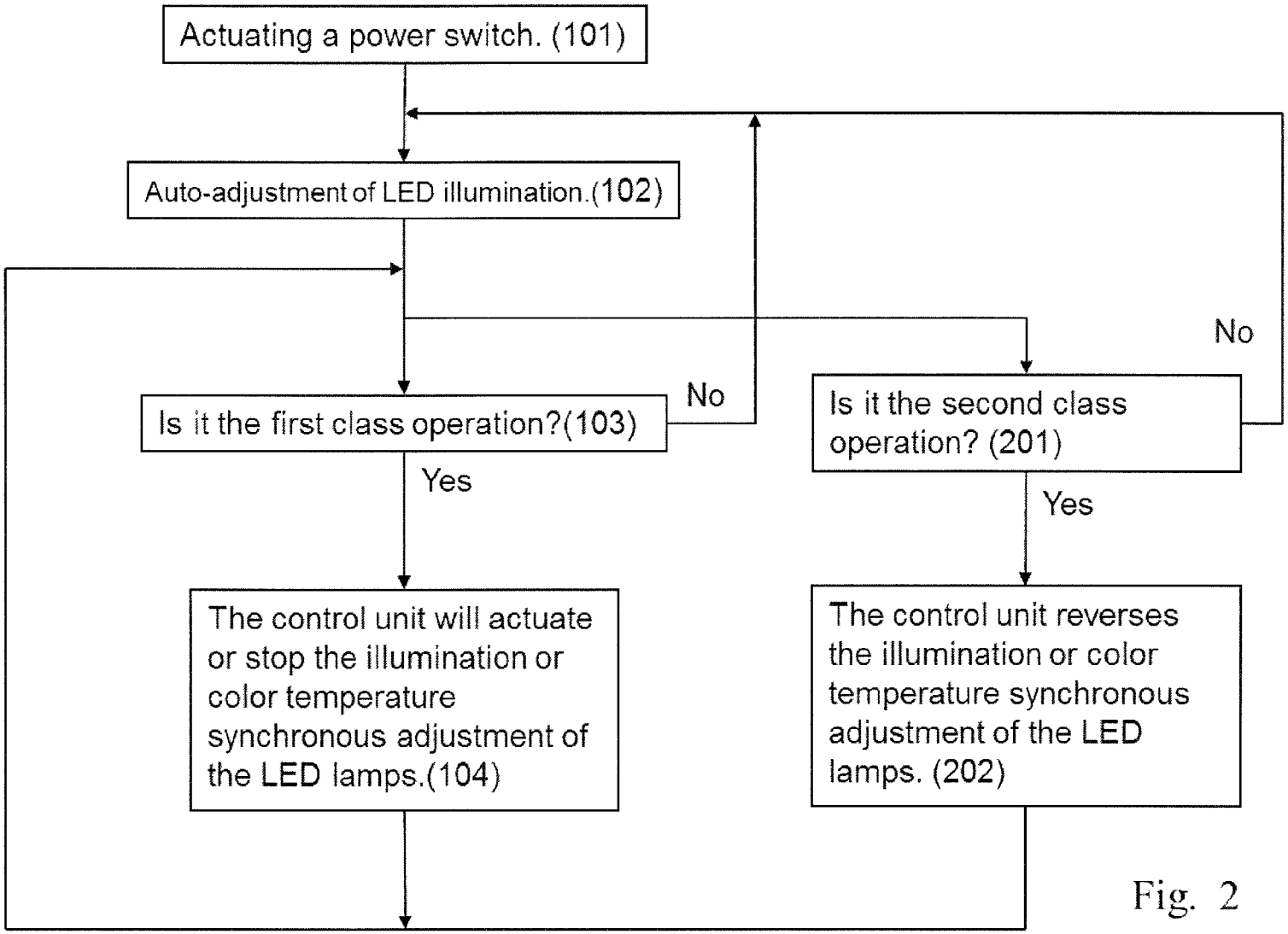
FIG. 2 is a block diagram showing the process in a second embodiment of the present invention.
Figure 3:
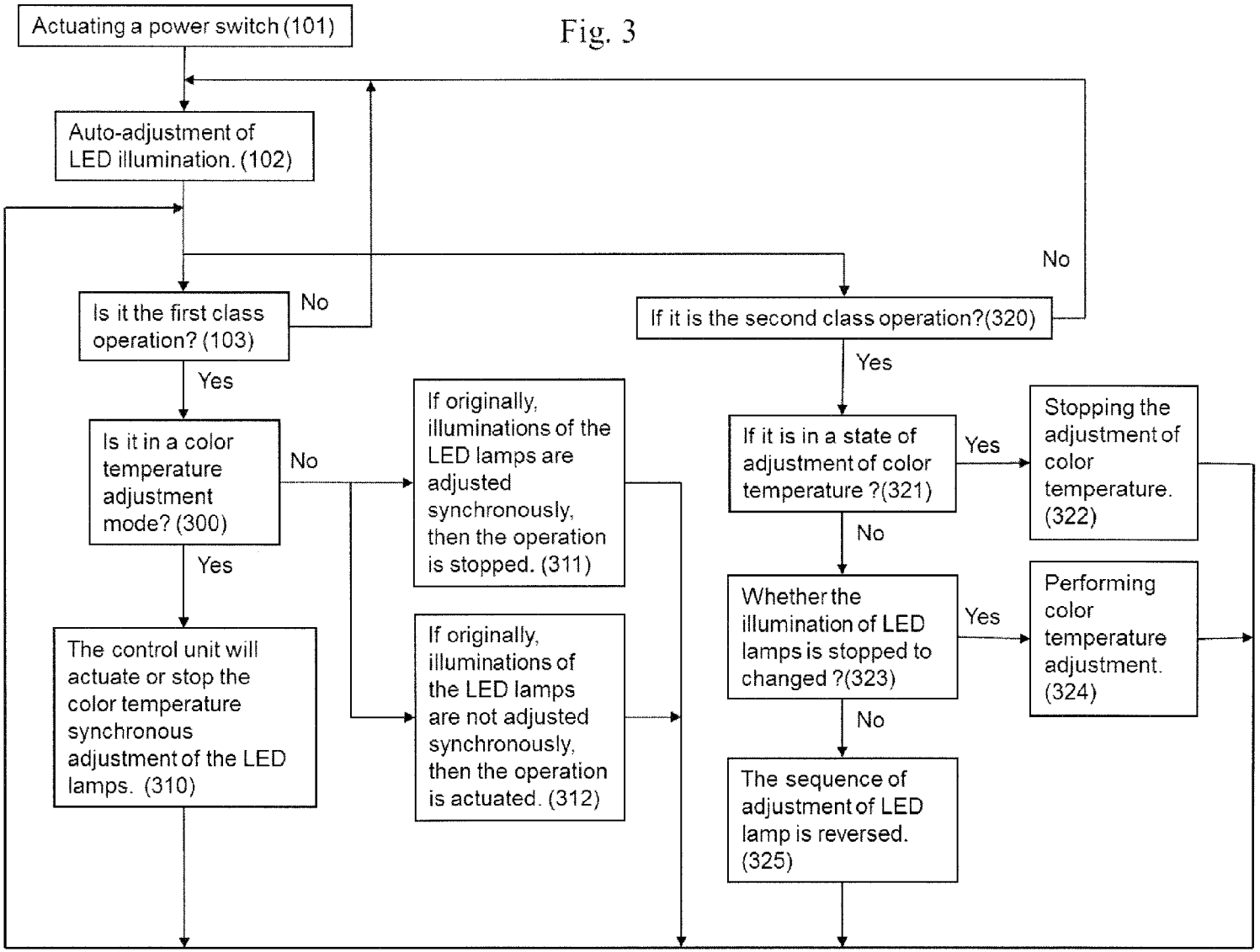
FIG. 3 is a block diagram showing the process in a third embodiment of the present invention.
Figure 4:
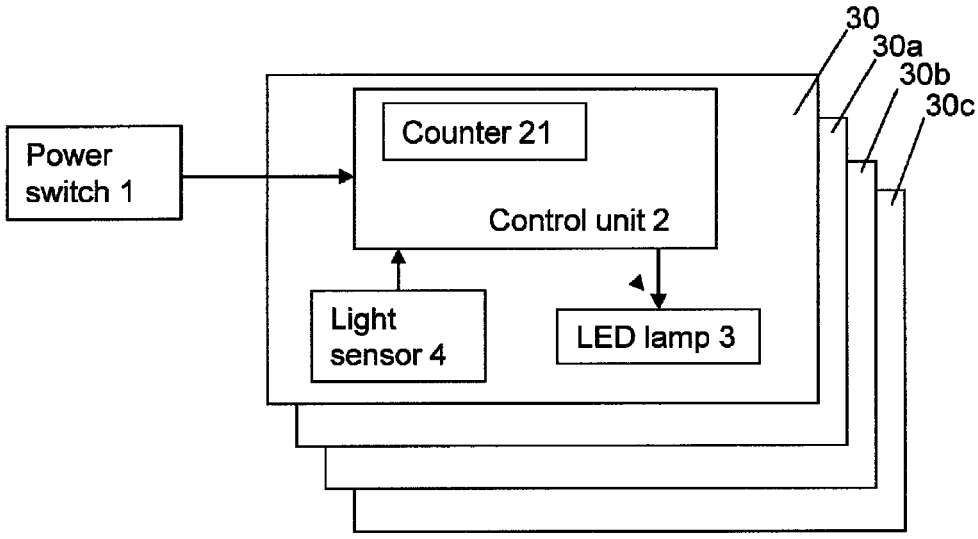
FIG. 4 is a schematic view showing the lamp set structure in the present invention.

Referring to the flow diagrams in FIGS. 1 to 3 and a schematic view about the structure of the present invention as illustrated in FIG. 4, the method of the present invention will be described herein.

The present invention relates to a synchronously light adjusting method. The present invention performs light or color temperature synchronous and gradual adjustments for one or a plurality of light sources (30*a*, 30*b*, 30*c* and 30*d* in FIG. 4). The adjustment of high and low color temperature uses at least a high color temperature light source and a low color temperature light source. A control unit 2 serves to control the output of the at least two light sources so as to change the value of color temperatures of LED lamps 3 (light sources). In the present invention, the synchronism of each light source is based on the AC frequencies or periods of currents input to the light sources.

Referring to FIG. 4, each control unit 2 is set with a first class operation. The definition of the first class operation is that at least one power switch is switched through N times in a predetermined time duration, while other switching out of the duration is discontinuous with the switching within the duration. Herein, continuation can be defined as an interval between two successive switching operations is not over a predetermined time period. In that, N is a predetermined integer. For example, it can set the first class operation is to switch a power switch three times within 3 seconds and the time interval between two switching operations is not over 1.5 second. Therefore, if within three seconds, a power switch is switched 3 times and a time interval between each switching operation and other switching operation out of the duration of 3 seconds is over 1.5 second, then the operation is considered to match the definition of first class operation.

Another, a second class operation of the control unit 2 is defined as a power switch is switched through M times in a predetermined time duration, while other switching out of the duration is discontinuous with the switching within the duration. In that, M is a predetermined integer and is unequal to N. Herein, continuation can be defined as an interval between two successive switching operations is not over a predetermined time period.

The operation of the present invention will be further described herein with reference to FIGS. 1 to 4, firstly, a power switch is turned on (step 101) so that the control unit 2 enters into an auto light adjustment mode to drive an LED lamp 3 (step 102). The auto light adjustment mode of the control unit 2 has a plurality of preset illumination parameters which mean illumination differences between environmental illuminations and preset ideal illuminations before actuation of the LED lamp 3.

Referring to FIG. 4, it is illustrated that a light sensor 4 senses the environmental illumination, and then the control unit 2 adapts the environmental illumination to acquire one illumination parameter. Then the illumination of the LED lamp 3 is auto-adjusted based on the illumination parameter. The above mentioned control unit 2, the LED lamp 3 and the light sensor 4 are formed as a light adjustable lamp set 30. In this embodiment, it may have a plurality of control units 2, a plurality of LED lamps 3 and a plurality of light sensors 4. The number of the control units 2 is identical to that of the LED lamps 3. Therefore, they are formed as a plurality of light adjustable lamp sets 30, 30*a*, 30*b* and 30*c*. Each of the light adjustable lamp sets receives power from one power switch 1.

The control unit 2 can adjust the illumination of the LED lamp 3 continuously and slowly by the integrated method or by the average method so as to avoid the light sensor 4 is interfered by external objects (such as shadows of persons, or swaying of lights), which will cause that the illumination of the LED lamp 3 is unsteady by improper adjustments from the control unit 2. Thus the user will feel uneasy. With reference to FIG. 1, when the power switch is switched, a control unit 2 serves to detect whether the switching operation of the power switch is matched to the definition of the first class operation (step 103). If not, the process is returned to step 102.

If the control unit 2 determines that the switching operation is matched to the definition of the first class operation, the control unit 2 is configured to control a plurality of LED lamps to actuate or stop a set operation (step 104). Namely, if the set operation is performed, the control unit 2 is configured to stop the operation. If the set operation is not performed, the control unit 2 is configured to actuate the operation. Then the process returns to step 103. In the present invention, the set operation is one of an illumination adjustment operation and a color temperature adjustment operation. In detail, if the set operation means that the illuminations of the plurality of LED lamps are changed synchronously, the control unit 2 is configured to stop the synchronous adjustment of the illuminations. Alternatively, if the illuminations of the plurality of LED lamps are not changed synchronously, the control unit 2 is configured to actuate the synchronous adjustment of the illuminations.

Furthermore, if the set operation means that the color temperatures of the plurality of LED lamps are changed synchronously, the control unit 2 is configured to stop the synchronous adjustment of the color temperatures. Alternatively, if the color temperatures of the plurality of LED lamps are not changed synchronously, the control unit 2 is configured to actuate the synchronous adjustment of the color temperatures of the LED lamps. With reference to FIG. 2, a further embodiment of the present invention is illustrated. In this embodiment, other than above mentioned first class operation, the control unit 2 also determines whether of the switching operation is matched to the definition of the second class operation (step 201). If not, the process returns to the step 102. When the switching operation is matched with the second class operation, the control unit 2 is configured to cause a set operation to the one or the plurality of LED lamps to be reversed (step 202). Namely, if the illuminations of the LED lamps are adjusted from a dark state to a light state, then the control unit is configured to reverse the operation to be from the light state to the dark state, or if the color temperatures of the LED lamps are adjusted from a high value to a low value, then the control unit 2 is configured to reverse the operation to be from the low value to the high value, and vice versa. When above mentioned operation is completed, the process returns to step 103.

In the second class operation, the set operation is the synchronous change of the illuminations or the color temperature of the LED lamps. Namely, if the illuminations of the LED lamps are adjusted from a dark state to a light state, then the control unit 2 is configured to reverse the operation to be from the light state to the dark state, and vice versa. If the color temperatures of the LED lamps are adjusted from a high value to a low value, then the control unit 2 is configured to reverse the adjustment to be from the low value to the high value, and vice versa.

With reference to FIG. 3, another embodiment of the present invention is illustrated. This embodiment is expanded from the process of above embodiment. However, in this embodiment, the set operation means operation about color temperature instead of operation about illumination. Other than determining whether the process is in a color temperature adjusting mode, the illumination adjustment is added after the process of the color temperature adjustment.

The operation in this embodiment will be described herein. That is, in a first class operation, it is determined whether a color temperature adjusting mode is performed (step 300). If yes, the control unit 2 controls the plurality of LED lamps to actuate or stop the color temperature adjustment mode. The way of controlling is identical to those described above (step 310). That is: if the set operation means that the color temperatures of the plurality of LED lamps are changed synchronously, the control unit 2 is configured to stop the synchronous adjustment of the color temperatures. If the set operation means that the color temperatures of the plurality of LED lamps are not changed synchronously, the control unit 2 is configured to actuate the synchronous adjustment of the color temperatures.

When the plurality of LED lamps is not in a color temperature adjustment mode, while originally, the illumination of the plurality of LED lamps are changed synchronously, the control unit 2 stops the synchronous change of the illumination of the LED lamps (step 311). Another, when originally if the illumination of the plurality of LED lamps is not changed synchronously, the control unit 2 actuates the synchronous change of the illuminations of the LED lamps (step 312).

In this embodiment, a second class operation is set. It means that a power switch is switched through M times in a predetermined time duration, while other switching out of the duration is not continuous with the switching within the duration. In that, M is a predetermined integer and is unequal to N. When the control unit 2 determines that the switching operation is a second class operation (step 320), then the control unit 2 determines whether the plurality of LED lamps are operated in a color temperature adjustment mode (step 321). If yes, the operation of color temperature adjustment mode is stopped (step 322). On the contrary, if it is determined that operations of the plurality of LED lamps are not under the color temperature adjustment mode, then the control unit 2 determines whether the change of the illuminations of the plurality of LED lamps is stopped (step 323). If yes, the control unit 2 controls the operation of LED lamps to enter into the color temperature adjustment mode (step 324). If the plurality of LED lamps are not under the color temperature adjustment mode, but under a mode of illumination adjustment, then the trend of change of the illumination is reversed (step 325). Namely, if the illumination of the plurality of LED lamps originally changes from a light to dark, then it trend is reversed to be from dark to light.

In that, the change of illuminations of the LED lamps are from a lightest state, a darkest state, or a previous illumination when the lamp is turned off, or the change of color temperatures of the LED lamps are from a highest state, a lowest state, or a previous state when the lamp is turned off. Therefore, under the condition that there are many lamps, and no signal connection, the initial states of the adjustments of the LED lamps 3 are identical.

The synchronism of the adjustments of the LED lamps is based on the AC power source frequency or period. When the control unit 2 determines that the switching operation of the power switch is not the first or second class operation as defined above, one counter of the control unit 2 is reset and the accumulation of the times of the counter is stopped. If the switching operation of the power switch of the control unit 2 is matched to the above mentioned first class operation or the second class operation, the accumulation of the counting number is started based on the AC current frequency or period of a current flowing to the power switch.

When the accumulation of the counting number is achieved to a set value, the illumination or color temperature is adjusted through one step and the counter is reset; then the counter counts again to the set value, the illumination or color temperature are further adjusted through one step; above operation is repeated until the illumination is adjusted to a darkest state or a lightest state; or color temperature has achieved to a highest state or a lowest state; or the control unit emitting a stop instruction; then the counter is rest and accumulation of counting number is also stopped.

By above mentioned operation, a single power switch 1 will control all the light adjustable lamp sets 30, 30*a*, 30*b*, and 30*c* synchronously. When the control unit 2 or LED lamp 3 of one light adjustable lamp set is destroyed, the control unit 2 and LED lamp 3 of other light adjustable lamp set are not affected. Then adjustment of the LED lamp 3 of each light adjustable lamp set is independently controlled by the control unit 2.

Referring to FIG. 4, a schematic view and block diagram of a preferred embodiment of the present invention is illustrated. It is illustrated that the device of the present invention includes a plurality of LED lamps 3, at least one light sensor 4, at least one control unit 2 and a power switch 1.

The light sensor 4 is arranged to a related LED lamp 3 or near the LED lamp 3.

Figure 5:
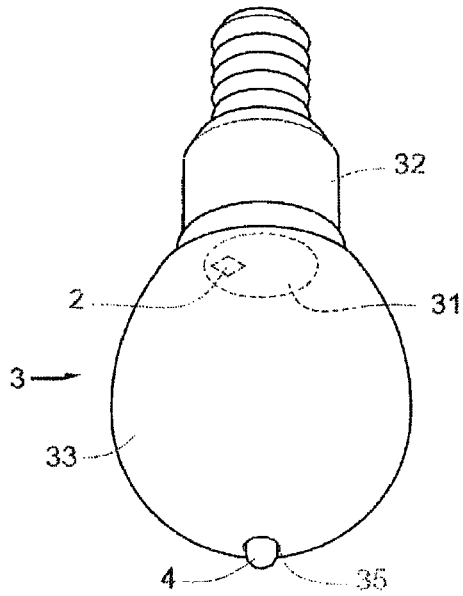
FIG. 5 is a perspective view showing a bulb-like LED lamp according to the present invention.

Each LED lamp 3 has a housing 32 and a transparent mask 33 communicated to the housing 32 (referring to FIG. 5). The LED lamp 3 is installed within the mask 33 and the light sensor 4 is also in the mask 33.

An LED driver 31 is installed within the housing 32. The LED driver is electrically connected to LEDs (not shown). The control unit 2 includes a detector (not shown) and a logic circuit (not shown). The control unit 2 can be formed with the driver 31 integrally so that the control unit 2 is electrically connected to the LED lamp 3 and the light sensor 4. The control units 2, LED lamps 3 and light sensors 4 are formed as a plurality of light adjustable lamp sets 30, 30*a*, 30*b* and 30*c*.

The power switch 1 can be connected between the control unit 2 and an AC (alternative current) power source.

Therefore, by actuating the power switch 1 with an operation matching to above defined first class operation or second class operation, the control units 2 and light sensors 4 of all light adjustable lamp sets 30, 30*a*, 30*b* and 30*c* are drivable synchronously and thus the LED lamps 3 of all light adjustable lamp sets 30, 30*a*, 30*b* and 30*c* are controlled synchronously. Other operations are identical to above mentioned embodiments.

By above mentioned structure, the control unit 2 can automatically adjust the illumination of the LED lamp 3 based on the environmental illumination sensed by the light sensor 4. Furthermore, the illumination of the LED lamp 3 can be manually adjusted through the operation of the power switch.

The embodiments about the device of the present invention will be described hereinafter.

Figure 6:
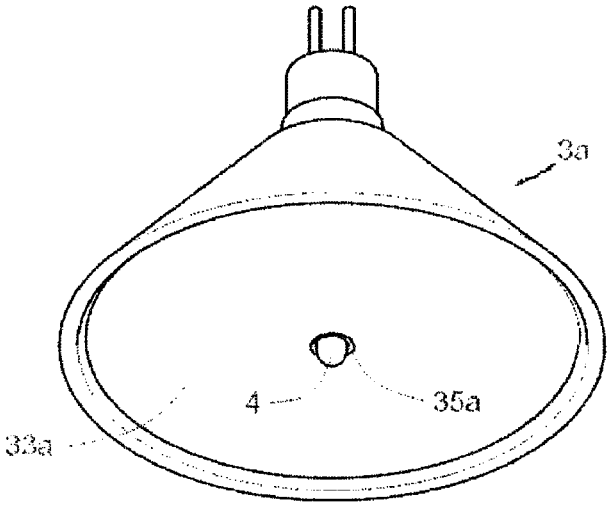
FIG. 6 is a perspective view showing the LED lamp of the present invention having a form of a recessed luminaire.

In one embodiment, the LED lamp 3, 3*a* is a bulb or a recessed luminaire, as illustrated in FIGS. 5 and 6. The transparent mask 33, 33*a* is formed with a hole 35, 35*a* at a lower side thereof. The light sensor 4 is installed within the positioning hole 35, 35*a*.

Figure 7:
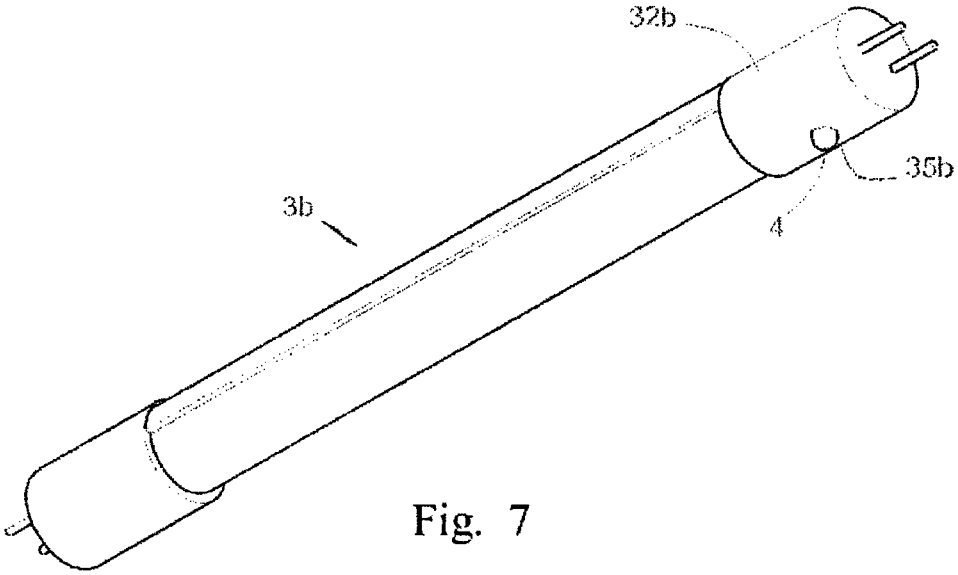
FIG. 7 is a perspective view showing the LED lamp of the present invention having a form of a tube.

The LED lamp 3*b* has a form of a tube (referring to FIG. 7) and one end of the LED lamp 3*b* has a housing 32*b* with a positioning hole 35*b* at a lower side thereof. The light sensor 4 is installed within the positioning hole 35*b*.

Figure 8:
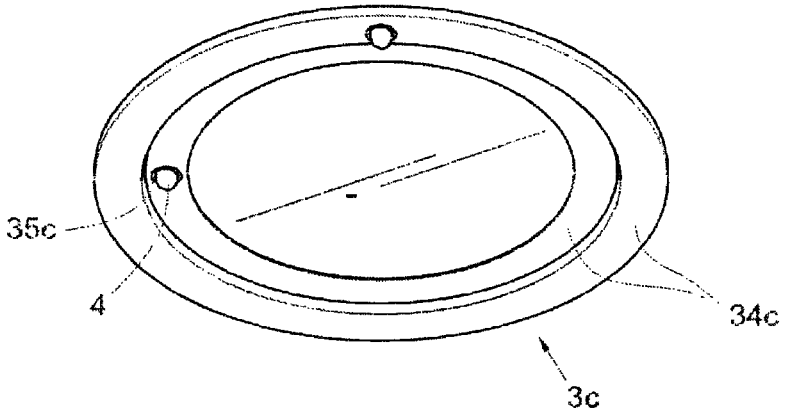
FIG. 8 is a perspective view showing another LED lamp of the present invention having a form of a recessed luminaire.
Figure 9:
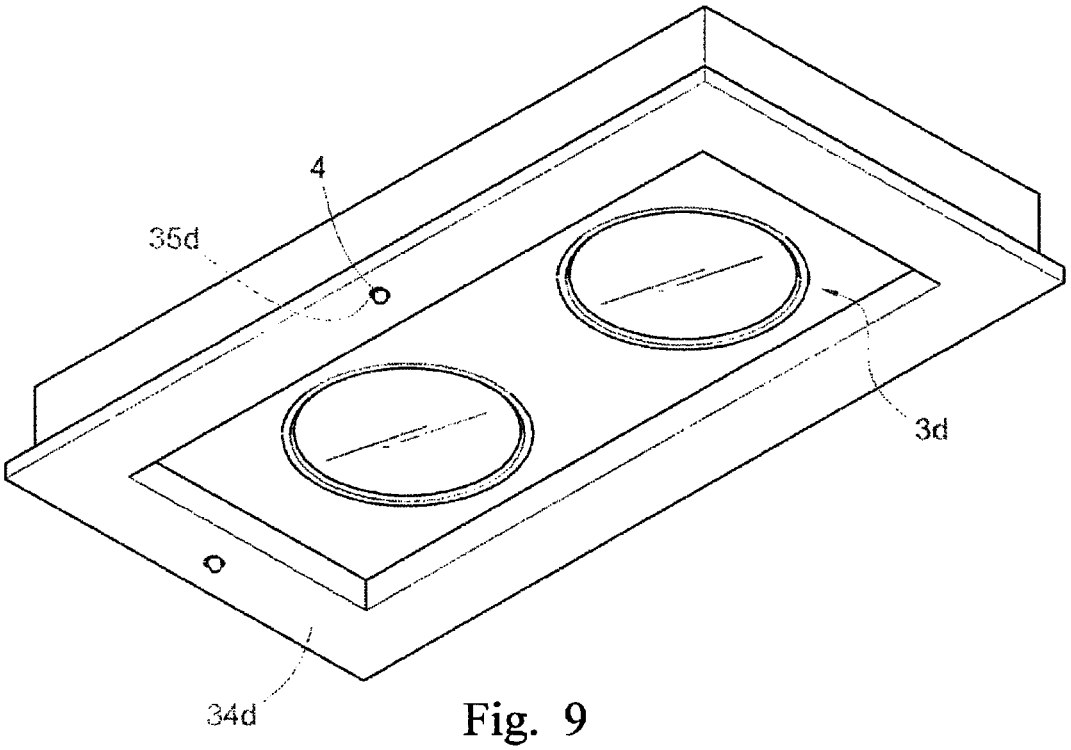
FIG. 9 is a perspective view showing a further LED lamp of the present invention having a form of a recessed luminaire.

In another embodiment, the LED lamp 3*c*, 3*d* is installed within the lamp frame 34*c*, 34*d* having a round shape, a rectangular shape, etc. The light sensor 4 is installed within the positioning hole 35*c*, 35*d*, as illustrated in FIGS. 8 and 9.

Figure 10:
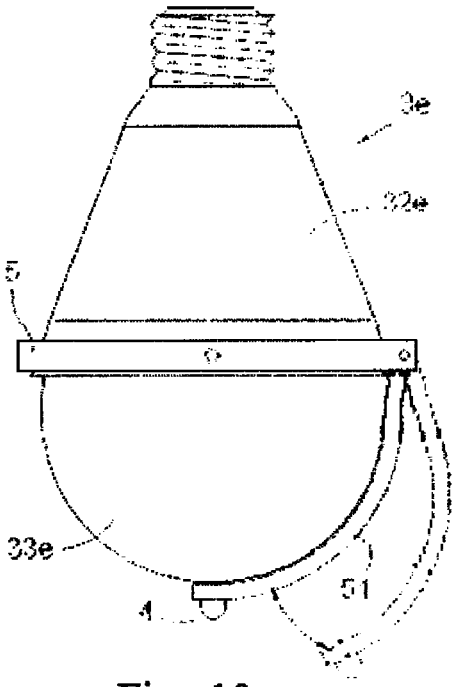
FIG. 10 is a front view of bulb-like LED lamp according to the present invention.
Figure 11:
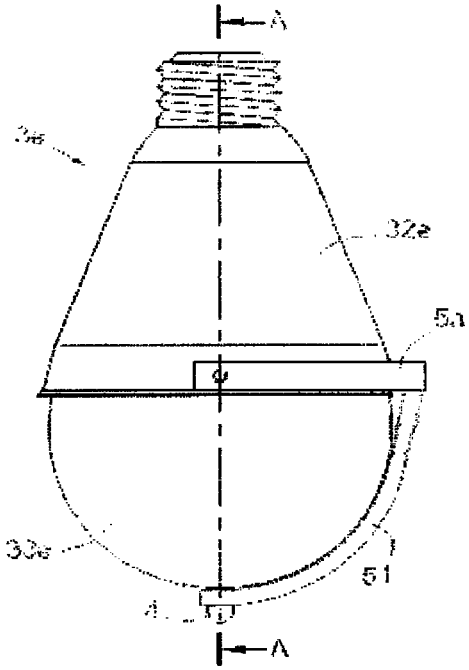
FIG. 11 is a front view of FIG. 10 with an extra element being added.

In one embodiment, a heat dissipating casing 32*e* of the LED lamp 3*e* is connected to the transparent mask 33*e* and has a form of a bulb (referring to FIG. 10). A periphery of the casing 32*e* is installed with a round ring 5 which is adjacent to the transparent mask 33*e*. The round ring 5 is elastic. A cambered strip 51 has an end retained to the round ring 5 which extends along a surface of the transparent mask 33*e* to a bottom of the LED lamp 3*e*. The light sensor 4 is installed at a lower end of the cambered strip 51 and is thus at the bottom of the LED lamp 3*e*. Therefore, the structure is simplified and can be assembled easily. See FIG. 11, the ring 5*a* may have a C shape.

Beside, a top of the cambered strip 51 may be pivoted to the ring 5, 5*a*. Or the cambered strip 51 is elastic. In use, the lower end of the strip 51 is adjusted to be at an outer side of the ring 5, 5*a* so that the ring 5, 5*a* can be installed at a periphery of the casing 32*e* from an upper side thereof or from a lateral side thereof.

Figure 12:
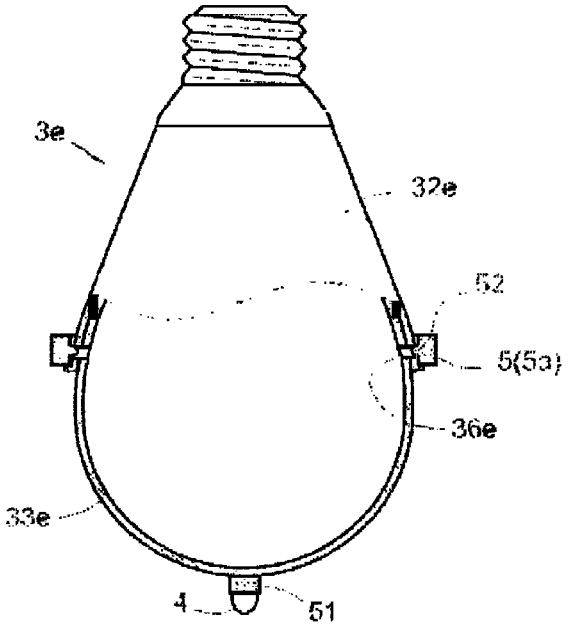
FIG. 12 is a cross section view along line A-A in FIG. 10.

Each of the two opposite sides of the casing 32*e* is formed with a through hole 36*e* or a concave portion 36*e* (referring to FIG. 12). An inner wall of the ring 5 is formed with two protrusions 52 with respect to the through holes of the casing 32*e*. When the ring 5 is engaged to a periphery of the casing 32*e*, the protrusions 52 will engage to the through holes 36*e* to position the ring 5 to the periphery of the casing 32*e*. Thus the through hole 36*e* will communicate to an interior of the casing 32*e*. As a result, the power line of the light sensor 4 passes through the through hole 36*e* (or concave portion) to be within the casing 32*e* and then be connected to the control unit 2

Figure 13:
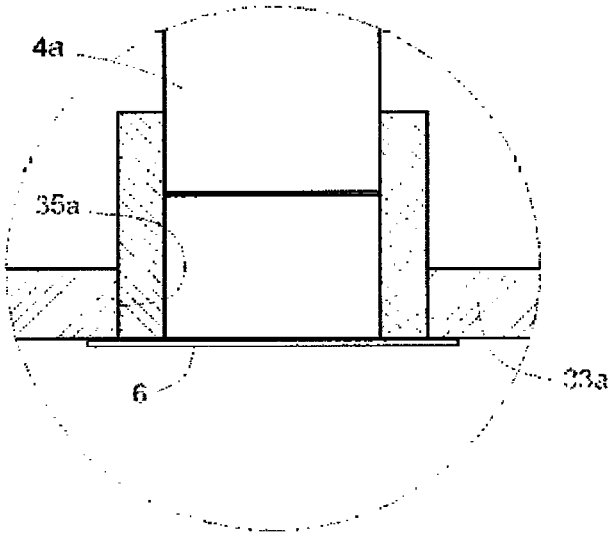
FIG. 13 is a cross sectional view showing the structure in FIG. 6 with an extra element being added.

In one embodiment, the light sensor 4*a* is retracted into the positioning hole 35*a* (referring to FIG. 13). A semi-transparent label 6 is used to seal an opening of the positioning hole 35*a* so that the label 6 is nearby the light sensor 4*a* for isolating light incident into the light sensor 4*a* for adjusting the light intensity of light incident into the light sensor 4*a*.

Figure 14:
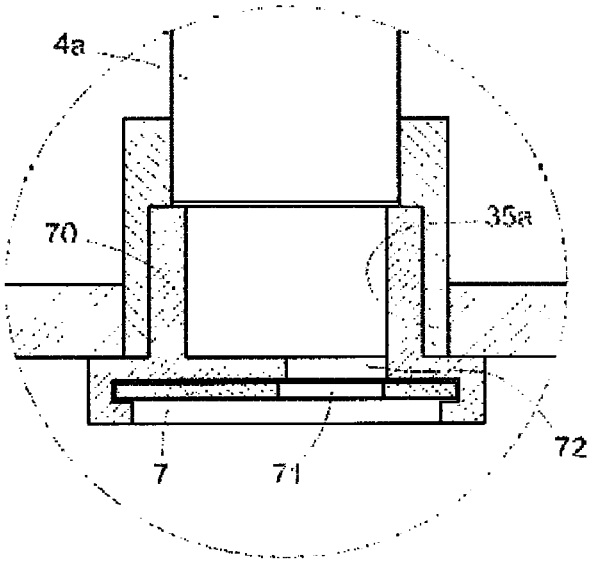
FIG. 14 is a cross sectional view showing the structure in FIG. 6 with another extra element being added.
Figure 15:
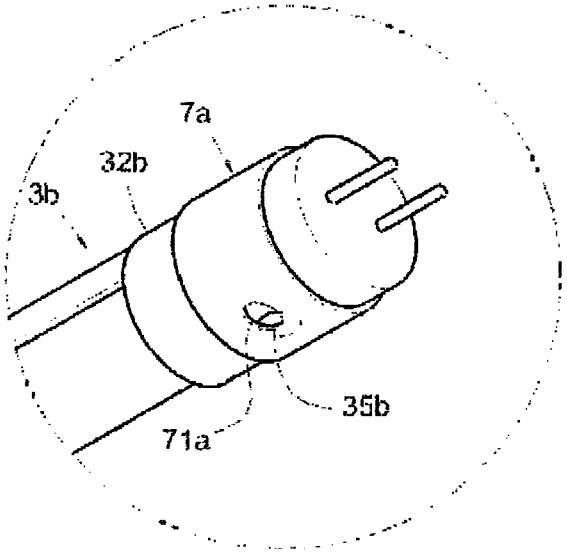
FIG. 15 is a partial perspective view showing the structure in FIG. 7 with an extra element being added.

In one embodiment, the positioning hole 35*a* is a light mask 7 for controlling light emitting to the light sensor 4*a* through the positioning hole 35*a* (referring to FIGS. 14 and 15) so that the light mask 7 is positioned near the light sensor 4*a*. The light mask 7 has a window 71 positioned corresponding to the positioning hole 35*a* and the light sensor 4*a*. In the present invention, the light mask 7 is rotatable. By adjusting the position of the light mask 7, the size of the opening of the light sensor 4*a* is controllable.

Figure 16:
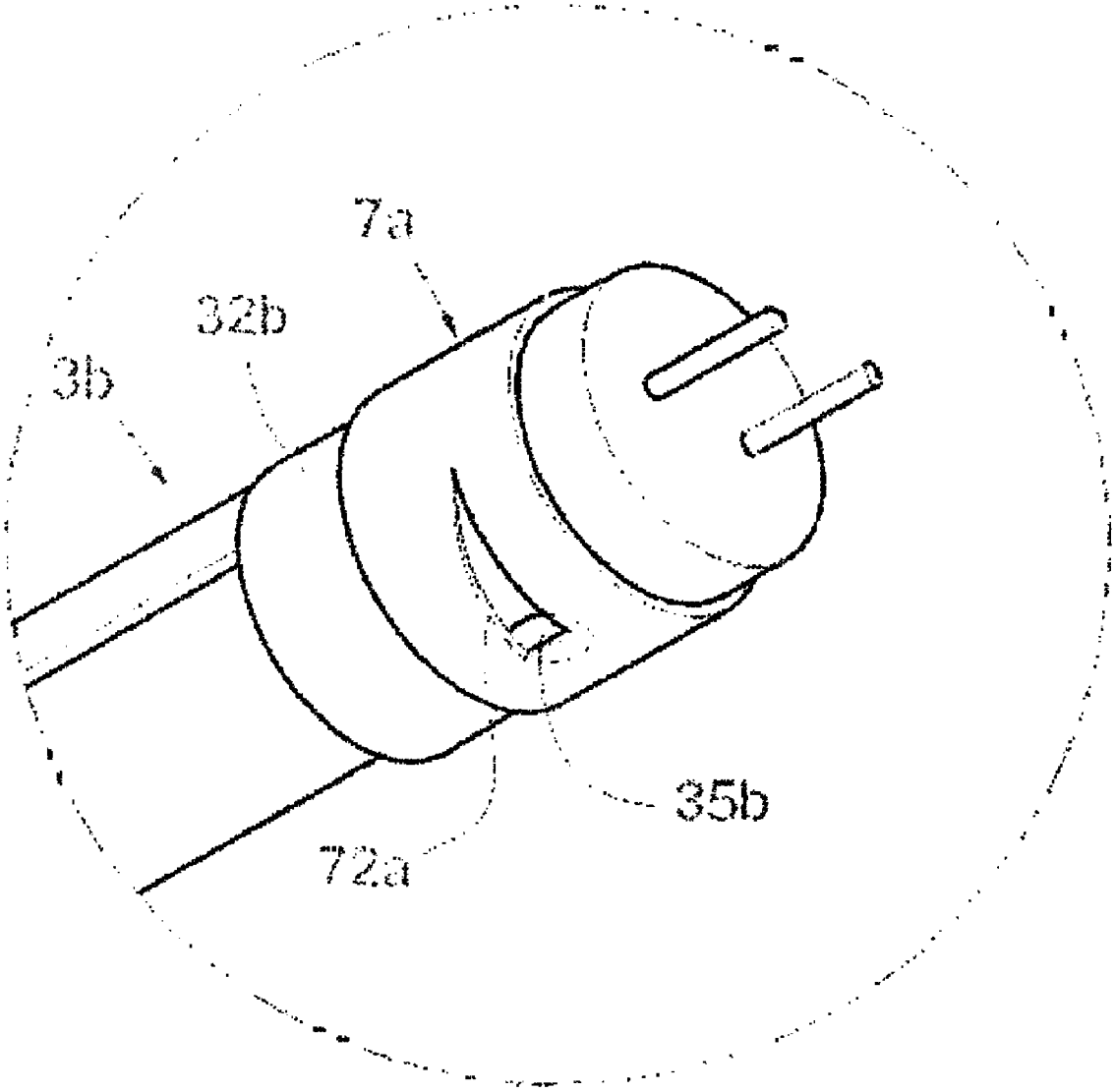
FIG. 16 is a partial perspective view showing the structure in FIG. 7 with another extra element being added.

As shown in FIG. 16, the light mask 7*a* is a sleeve and is installed at a casing 32*b* at one side of the LED lamp 3*b* for shielding an opening of the positioning hole 35*b* of the casing 32*b*. By rotating the light mask 7*a*, a position of the window 72*a* with respect to the positioning hole 35*b* is controllable, and thus the size of the opening of the light sensor 4 is controllable so as to control intensity of light incident to the light sensor 4.

In the present invention, the windows 71*a*,72*a* may have a round shape or a long shape or a triangle shape.

As comparing the present invention with the prior art, the present invention has the following advantages: 1: After the lamps are actuated, the illumination is controllable automatically and intellectually, and moreover, they can be controlled manually. It is easily to be installed and convenient in operation. Also, the power used is saved. 2: Only one power switch is used to control a plurality of LED lamps. The operation is personalized. When one of the LED lamps destroys, controlling of other LED lamps is not affected. 3: The illumination of each LED lamp is controlled independently based on the environmental illumination. The illuminations of all LED lamps are controllable in good tune. Therefore, even the LED lamps are dispersed in different positions of one space, the desired illumination can be derived. 4: No extra signal wire and arrangement is used. The illuminations and color temperatures of a plurality of LED lamps can be adjusted synchronously. 5. No extra control device or signal wire is used and the assembly work is easy and convenient. The current used bulbs, tubular lamps, or other lamps are suitable. They can be widely used and are power-saved. 6: A proper color temperature matching the requirement of users is acquired conveniently. Furthermore, the illuminations of the LED lamps can be achieved by a desired illumination. Thus the lighting quality is promoted.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A synchronous light adjustment method for illumination or color temperature synchronous adjustment of at least one lamp, in that synchronism of a plurality of lamps are based on a frequency or a period of AC power source input to the at least one lamp, the method comprising the steps of:

setting a first class operation which defines an operation that: at least one power switch is switched through N limes in a predetermined time duration, while other switching out of the duration is discontinuous with the switching within the duration; and N is a predetermined integer;

using a control unit to detect whether a switching operation about a power switch matches to the first class operation; and when the switching operation to the power switch is matched with the first class operation, the control unit controlling the plurality of LED lamps to actuate or stop a set operation; when the set operation is performed, the control unit is configured to stop the operation; when the set operation is not performed, the control unit is configured to actuate the set operation; wherein the set operation is one of an illumination adjustment and a color temperature adjustment.

2. The method of claim 1, wherein when the set operation is the illumination adjustment which means that the illuminations of the plurality of LED lamps are changed synchronously, the control unit is configured to stop the synchronous adjustment of the illuminations; and when the illuminations of the plurality of LED lamps are not changed synchronously, the control unit is configured to actuate the synchronous adjustment of the illuminations.

3. The method of claim 1, wherein when the set operation is the color temperature adjustment which means that the color temperatures of the plurality of LED lamps are changed synchronously, the control unit is configured to stop the synchronous adjustment of the color temperatures; alternatively, when the color temperatures of the plurality of LED lamps are not changed synchronously, the control unit is configured to actuate the synchronous adjustment of the color temperatures of the LED lamps.

4. The method of claim 3, wherein when the set operation is that no color temperature is adjusted, then when the set operation means that the illuminations of the plurality of LED lamps are changed synchronously, the control unit is configured to stop the synchronous adjustment of the illuminations; and when the illuminations of the plurality of LED lamps are not changed synchronously, the control unit is configured to actuate the synchronous adjustment of the illuminations.

5. The method of claim 4, wherein a second class operation of the control unit is set, the second class operation is defined as a power switch is switched through M times in a predetermined time duration, while other switching out of the duration is discontinuous with the switching within the duration; in that, M is a predetermined integer and is unequal N;

when the switching operation is not a second class operation, when the plurality of LED lamps are in state of adjustment of color temperature, then the adjustment of color temperature is stopped; on the contrary, when the plurality of LED lamps are not at a state of adjustment of color temperature, and no illumination adjustment is performed, then the control unit actuates the color temperature adjustment to the LED lamps;

when the plurality of LED lamps are not at a state of color temperature adjustment, but the illumination is adjusted, then the trend of the illumination change is reversed, that is: when the illumination from a light state to a dark state, the control unit is configured to reverse the operation to be from the dark state to the light state; and vice versa.

6. The method of claim 1, wherein a second class operation of the control unit is set, the second class operation is defined as a power switch is switched through M times in a predetermined time duration, while other switching out of the duration is discontinuous with the switching within the duration; in that, M is a predetermined integer and is unequal to N;

other than above mentioned first class operation, the control unit also determines whether the switching operation is matched to the definition of the second class operation; when the switching operation is matched with the second class operation, the control unit is configured to cause the set operation to the LED lamps to be reversed; wherein the set operation is illumination adjustment or color temperature adjustment;

when the illuminations of the LED lamps are adjusted from a dark state to a light state, the control unit is configured to reverse the operation to be from the light state to the dark state; or when the color temperatures of the LED lamps are adjusted from a high value to a low value; then the control unit is configured to reverse the operation to be from the low value to the high value, and vice versa.

7. The method of claim 6, wherein the set operation is synchronous and gradual adjustment of illumination; and when the illumination is changed from a light state to a dark state, the set operation causes that the control unit reverses the operation to be from the dark state to the light state; and vice versa.

8. The method of claim 6, wherein the set operation is synchronous and gradual adjustment of color temperature; and when the color temperatures of the LED lamps are adjusted from a high value to a low value, then the control unit is configured to reverse the operation to be from the low value to the high value, and vice versa.

9. The method of claim 6, wherein the synchronism of the adjustments of the LED lamps is based on the AC power source frequency or period of currents supplied to the LED lamps; when the control unit determines that the switching operation of the power switch is not the first or second class operation as defined above, one counter of the control unit is reset and the accumulation of counting number is stopped; when the switching operation of the power switch of the control unit is matched to the first class operation or the second class operation, the accumulation of the counting number is started based on the AC power source frequency or period of a current flowing to the power switch;

when the accumulation of the counting number is achieved to a set value, the illumination or color temperature of the LED lamp is adjusted through one step and the counter is reset; then the counter counts again to the set value, and the illumination or color temperature is further adjusted through one step; above operation is repeated until the illumination is at a darkest state or at a lightest state; or color temperature has achieved to a highest state or a lowest state; or the control unit transfers a stop instruction; and then the counter is reset and accumulation of counting number is also stopped.

10. The method of claim 6, wherein when operations of the power switch are unmatched to the first or second class operation, the control units is configured to drive the LED lamps independently to adjust the illumination of the LED lamps based on environmental illumination detected by the light sensor.

11. The method of claim 1, wherein the change of illuminations of the LED lamps are initially actuated from a lightest state, a darkest state, or a previous illumination when the lamp is turned off, or the change of color temperatures of the LED lamps are initially actuated from a highest state, a lowest state, or a previous state when the lamp is turned off.

12. A synchronous light adjustment device for illumination or color temperature synchronous adjustment of at least one lamp, comprising:

one or a plurality of LED lamps;

one or a plurality of light sensors arranged on the LED lamps or near the LED lamps;

one or a plurality of control units electrically connected to the LED lamps and light sensors;

a power switch electrically connected to the control units and a power source; as the power switch being turned on, the control units is configured to drive the LED lamps independently to adjust the illumination of the LED lamps based on environmental illumination detected by the light sensor;

wherein when switching times of the power switch are matched to predetermined operations, the control unit is configured to enter into manual operation modes to adjust illuminations and color temperatures of the LED lamps, or the color temperature returns to an auto-operation mode from the manual operation mode; in that the predetermined operation means—that at least one power switch is switched through N times in a predetermined time duration, while other switching out of the duration is discontinuous with the switching within the duration; and N is a predetermined integer; and the synchronism of the adjustments of the LED lamps are based on the AC power source frequency or period of currents supplied to the LED lamps; when the control unit determines that the switching operation of the power switch is unmatched the defined operation, one counter of the control unit is reset and the accumulation of the times of the counter is stopped; when the switching operation of the power switch of the control unit is matched to the above mentioned first class operation or second class operation, the accumulation of the counting number is started based on the AC power source frequency or period of a current flowing to the power switch;

when the accumulation of the counting number is achieved to a set value, the illumination or color temperature of the LED lamp is adjusted through one step and the counter is reset; then the counter counts again to the set value, and the illumination or color temperature are further adjusted through one step; above operation is repeated until the illumination is at a darkest state or at a lightest state; or color temperature has achieved to a highest state or a. lowest state; or the control unit emitting a stop instruction; then the counter is rest and accumulation of counting number is also stopped.

13. The device of claim 12, wherein the light sensor is installed within a positioning hole and the positioning hole is formed in a transparent mask, or a casing or a lamp frame, or in a casing of a tube lamp.

14. The device of claim 12, wherein the LED lamp has a casing; a ring enclosing the casing; a cambered strip is installed to the ring and extends along a surface of the LED lamp to a bottom of the LED lamp; the light sensor is installed to a bottom of the cambered strip and is positioned on the bottom of the LED lamp; and the cambered strip is formed as a ring or has a C shape.

15. The device of claim 14, wherein the cambered strip is fixed to or pivotal to the ring, and is electrically connected to the light sensor through the cambered strip.

16. The device of claim 12, wherein the light sensor is installed with a label adhered near the light sensor to shield part of light incident to the light sensor.

17. The device of claim 12, wherein a light shielding element is movably installed near the light sensor for shielding part of light incident to the light sensor; and the light shielding element has a window positioned corresponding to the light sensor.

* * * * *